US007949268B2

(12) United States Patent
Burry et al.

(10) Patent No.: US 7,949,268 B2
(45) Date of Patent: May 24, 2011

(54) DYNAMIC PHOTO RECEPTOR WEAR RATE ADJUSTMENT BASED ON ENVIRONMENTAL SENSOR FEEDBACK

(75) Inventors: Aaron Michael Burry, Ontario, NY (US); Kenny-tuan T. Dinh, Webster, NY (US); Karl E. Kurz, Rochester, NY (US); Bruce E. Thayer, Webster, NY (US); Michael F. Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 345 days.

(21) Appl. No.: 12/244,395

(22) Filed: Oct. 2, 2008

(65) Prior Publication Data

US 2010/0086321 A1 Apr. 8, 2010

(51) Int. Cl.
*G03G 15/00* (2006.01)
*G03G 15/02* (2006.01)

(52) U.S. Cl. ..... 399/44; 399/26; 399/50

(58) Field of Classification Search ..... 399/44, 399/50, 48, 26

See application file for complete search history.

(56) References Cited

U.S. PATENT DOCUMENTS 4,583,835 A * 4/1986 Harada
5,678,129 A * 10/1997 Yasuda et al. ..... 399/50
6,611,665 B2 8/2003 DiRubio et al.
7,764,888 B2 * 7/2010 Hagiwara et al. ..... 399/44
2007/0077079 A1 * 4/2007 Kim et al. ..... 399/44
2007/0189788 A1 * 8/2007 Hagiwara et al. ..... 399/44
2008/0152371 A1 6/2008 Burry et al.
2008/0170869 A1 7/2008 Ramesh et al.

FOREIGN PATENT DOCUMENTS

EP 735434 A2 * 10/1996
JP 09311530 A * 12/1997
JP 2000172054 A * 6/2000
JP 2003057924 A * 2/2003

* cited by examiner

*Primary Examiner* — Susan S Lee
(74) *Attorney, Agent, or Firm* — Oliff & Berridge, PLC

(57) ABSTRACT

A xerographic marking engine adjusts a charging actuator value, such as an AC peak-to-peak voltage or an AC peak-to-peak current, based on a determined knee value, $V_{KNEE}$, of a charge curve for an imaging apparatus photoreceptor within the xerographic marking engine and environmental sensor data. The environmental sensor data may measure environment temperature and environment humidity. In near A-zone environments, for example, operational environments in which the temperature is 80 degrees Fahrenheit and the relative humidity is 80%, the charging actuator value may be selected to achieve a predetermined photoreceptor wear rate that avoids print quality defects due to lateral charge migration. In other than A-zone environments, the charging actuator value may be selected to minimize the photoreceptor wear rate, while avoiding print quality defects. The described approach allows optimal photoconductor wear to be achieved, in all operational environments, without increasing the risk of print quality defects.

20 Claims, 10 Drawing Sheets

DYNAMIC PHOTO RECEPTOR WEAR RATE ADJUSTMENT BASED ON ENVIRONMENTAL SENSOR FEEDBACK

CROSS-REFERENCE TO RELATED APPLICATIONS

This application is related to U.S. patent application Ser. No. 11/644,276, filed Dec. 22, 2006, by Aaron M. Burry, Christopher A. DiRubio, Mike Zona, Paul C. Julien, Eric S. Hamby, Palghat S. Ramesh, and William C. Dean, and entitled, "Photoconductor Life Through Active Control of Charger Settings;" and U.S. patent application Ser. No. 11/623,361, filed Jan. 16, 2007, by Phalgat S. Ramesh, Aaron M. Burry, Christopher A. DiRubio, and William C. Dean, and entitled, "Mass-Based Sensing of Charging Knee for Active Control of Charger Settings." The disclosures of the related applications are incorporated by reference in their entirety.

BACKGROUND

This disclosure generally relates to control of xerographic marking engines, such as copiers and laser printers.

The basic xerographic process used in a xerographic imaging device generally involves an initial step of charging a photoconductive member to a substantially uniform potential, $V_{charge}$. The charged surface of the photoconductive member is thereafter exposed to a light image of an original document to selectively dissipate the charge thereon in selected areas irradiated by the light image. This procedure records an electrostatic latent image on the photoconductive member corresponding to the informational areas contained within the document being produced. The latent image is then developed by bringing a developer material including toner particles adhering triboelectrically to carrier granules into contact with the latent image. The toner particles are attracted away from the carrier granules to the latent image, forming a toner image on the photoconductive member which may be transferred directly to a copy sheet or transferred to an intermediate transfer belt and subsequently transferred to a copy sheet. The copy sheet having the toner image thereon is then advanced to a fusing station for permanently affixing the toner image to the copy sheet in an image configuration.

Control of the initial field strength, $V_{charge}$, and uniformity of the charge on the photoconductive member is very important because consistently high-quality reproductions are best produced when a uniform charge having a predetermined magnitude is obtained on the photoconductive member. For example, in discharge area development, if the photoconductive member is overcharged too little developer material will be deposited on the photoconductive member. As a result, the copy produced by an overcharged photoconductor will be faded. Moreover, if the photoconductive member is excessively overcharged, the photoconductive member can become permanently damaged. If, however, the photoconductive member is not charged to a sufficient level, too much developer material will be deposited on the photoconductive member. The copy produced by an undercharged photoconductor will have a gray or dark background instead of the white background of the copy paper. In addition, areas intended to be gray will be black and tone reproduction will be poor.

The life of the photoconductor in a xerographic marking engine is typically limited by the occurrence of some form of print quality defect related to the photoconductor. One of the typical failure mechanisms is the slow wearing away of the surface layer of the photoconductor. Eventually, after enough of the surface layer has been worn away, print quality defects begin to appear in the prints generated using the worn photoconductor. An example of this type of defect is the charge deficient spots (CDS) defect that appears in some print engines when the photoconductor outer layer, i.e., the charge transport layer (CTL) has been worn down below a minimum threshold thickness.

Since photoconductors are typically somewhat expensive to replace, the life of a print engine's photoconductor can have a significant impact on the overall operational costs of the print engine.

SUMMARY

A typical response of the photoconductor potential as a function of the AC peak-to-peak voltage charging actuator is shown in FIG. 7. The location of the actuator saturation point in this curve is typically referred to as the "knee" of the charge curve (the point at which further increases in the actuator do not significantly affect the output photoconductor voltage after charging). Typically, non-uniform print quality is obtained for AC charging devices when the AC peak-to-peak actuator is operated below this knee value. In addition, under certain conditions, some print quality defects may occur for actuator values close to, but still slightly above, the knee of the charge curve. In response to photoconductor wear, and/or changes in operating conditions, the knee voltage of the charge curve for a photoconductor may change. Therefore, unless the knee voltage is periodically determined and updated, print quality may be adversely impacted due to the use of an AC charging actuator value that has been determined based on an inaccurate photoconductor knee value.

U.S. patent application Ser. No. 11/644,276 (application '276) describes several strategies for determining an appropriate AC charging actuator value. Specifically, the AC charging actuator may be actively adjusted in an effort to satisfy two constraints: reducing the amount of positive charge that is deposited onto the surface of the photoconductor, thereby extending the useful life of the photoconductor; and maintaining an acceptable distance between an actuator setting and the knee of the charging curve in order to minimize the possibility for the occurrence of charging related print quality defects. One approach described in application '276 uses an electrostatic voltmeter to measure the knee value of the photoconductor's charge curve. The electrostatic voltmeter is used to measure the charge on the photoconductor surface in response to a range of AC charging actuator values applied to the photoconductor's AC-biased charging device, thereby allowing the charge curve knee value to be accurately determined. In this manner, an AC charging actuator value may be periodically updated based on accurate knowledge of the photoconductor's charging curve knee.

U.S. Pat. No. 6,611,665 to DiRubio et al., (patent '665) hereby incorporated by reference in its entirety, describes a method for using a biased charging roller or a biased transfer roller device as an electrostatic voltmeter sensor for use in obtaining the position of the knee in the photoconductor charging curve. Such an approach may be used to support the dynamic assessment of photoconductor's charging curve knee values described in application '276.

U.S. patent application Ser. No. 11/623,361 (application '361) describes a mass-based sensing technique to locate the knee in the charging curve of a photoconductor. More specifically, the methodology proposes using an extended toner area coverage (ETAC) sensor or an area density coverage (ADC) sensor. The approach is based on the observation that the knee in the toner density curve for a photoconductor has been observed to correlate well with the knee in the charging curve for the same photoconductor. Such a sensor and related techniques may be used to support the dynamic assessment of photoconductor's charging curve knee values described in application '276.

By using techniques, such as those described in application '276, patent '665, and application '361, the AC charging actuator value associated with a knee in the photoconductor charging curve may be identified for each photoconductor used within a xerographic printer. Once the knee is located, an appropriate AC charging actuator value for an AC-biased charging device may be set by adding a predetermined $V_{PP}$-$V_{KNEE}$ voltage value to the determined $V_{KNEE}$ value. In this manner, an AC charging actuator value, $V_{PP}$, may be selected that maintains an AC peak-to-peak voltage of the charging actuator that is sufficiently high to avoid print quality defects, yet minimizes the AC peak-to-peak voltage of the charging actuator above the knee of the charge curve, thereby reducing photoconductor wear and extending the life of the photoconductor.

To extend the useful life of the photoreceptor, use of an approach to dynamically control the AC peak-to-peak voltage of the charging actuator, as described above, may be used in conjunction with a photoreceptor that includes an overcoat on the photoreceptor to protect the charge transport layer (CTL) of the photoreceptor. Through use of a durable overcoat material on top of the CTL, wear rates of around 6 nm/kilo-cycle have been measured. Recently it has been shown that the combination of the overcoat and charge control approaches may lead to even lower wear rates—on the order of 3 nm/kilo-cycle. For a photoreceptor drum with an overcoat of 4 um thickness, this would equate to an expected life of approximately 1.3 million cycles for the photoreceptor.

Unfortunately, in A-zone environments, i.e., operational environments in which the temperature is over 80 degrees Fahrenheit and the relative humidity is over 85%, such low wear rates can lead to another defect known as lateral charge migration (LCM). Under these environmental conditions, the use of a BCR charging device can lead to filming of the photoreceptor surface. If the photoreceptor surface is wearing at a sufficiently high rate, this contamination is abraded by the cleaning blade and does not buildup to a critical level. However, below a wear rate of roughly 5 nm/kilo-cycle this contamination does buildup and eventually leads to the LCM print quality failure.

Therefore, in all environments other than A-zone it is desirable to have the photoreceptor wear rate as low as possible, thereby maximizing photoreceptor life. However, in A-zone conditions such a low wear rate leads to the early onset of LCM related print quality failures. One approach for addressing this issue has been to construct systems such that the photoreceptor wear rate remains above the stated threshold of 5 nm/kilo-cycle, under all conditions. Unfortunately, such an approach achieves sub-optimal photoreceptor wear rates in non-A-zone operational environments. Thus, there is a clear need for a method to enable the very low wear rates achievable through combined overcoat and charge control while ensuring robustness to A-zone print quality defects.

The described approach for dynamically adjusting photoreceptor wear rate based on environmental sensor feedback, allows for the dynamic control of photoreceptor AC peak-to-peak voltage to include adjustments to charging actuator AC peak-to-peak voltage values based on the feedback received from environmental sensors. Based on feedback received from environmental sensors, such as relative humidity sensors and temperature sensors, the AC peak-to-peak voltage setting may be increased or decreased. Such dynamic adjustment of photoreceptor wear rate may be used to prevent the onset of the LCM defects while optimizing the photoreceptor life based on the current set of operating conditions.

An AC charging actuator value for an AC-biased charging device may be determined during a diagnostic mode or during normal operation mode and may be periodically reassessed by the xerographic printer based upon a predetermined number of pages printed since previously setting the AC charging actuator value, and/or based upon a predetermined period of time elapsing since previously setting the AC charging actuator value, and/or a change in operating environment relative humidity greater than a predetermined threshold, and/or a change in operating environment temperature greater than a predetermined threshold.

Exemplary embodiments actively adjust the AC charging actuator value, for example, an AC peak-to-peak driving voltage for an AC-biased charging device or an AC peak-to-peak driving current for an AC-biased charging device, using dynamic AC charging actuator value techniques to locate the current $V_{KNEE}$ value for a photoreceptor. Once the $V_{KNEE}$ value is located, an appropriate $V_{PP}$-$V_{KNEE}$ voltage value may be determined taking into account factors such as feedback from environmental sensors.

In this manner, a AC charging actuator value, $V_{PP}$, may be selected that maintains an AC peak-to-peak voltage of the charging actuator that is sufficiently high to avoid print quality defects, yet minimizes the AC peak-to-peak voltage of the charging actuator above the knee of the charge curve, thereby optimally reducing photoconductor wear and extending the life of the photoconductor under existing operational environment conditions while avoiding charging related print quality defects.

The disclosure describes a method of obtaining an AC charging actuator value, $V_{PP}$, for use during marking by a marking engine that includes determining a knee value, $V_{KNEE}$, of a charge curve for a photoreceptor within an imaging apparatus of the marking engine, measuring environment sensor data for the marking engine, determining an offset value, $V_{PP}$-$V_{KNEE}$, based in part on the received environment sensor data, and determining an AC charging actuator value, $V_{PP}$, based on the determined knee value and the determined offset value.

Further, the disclosure describes a xerographic marking engine control system that includes a $V_{KNEE}$ determining unit that determines a knee value, $V_{KNEE}$, of a charge curve for an imaging apparatus photoreceptor within the xerographic system, at least one environment sensor that provides environment sensor data, a long-life photoreceptor controller that determines an offset value, $V_{PP}$-$V_{KNEE}$, based in part on the environment sensor data received from the at least one environment sensor, and a charge device controller that determines an AC charging actuator value, $V_{PP}$, based on the determined knee value and the determined offset value.

BRIEF DESCRIPTION OF THE DRAWINGS

Exemplary embodiments will be described with reference to the accompanying drawings, where like numerals represent like parts, and in which.

EMBODIMENTS

Figure 1:
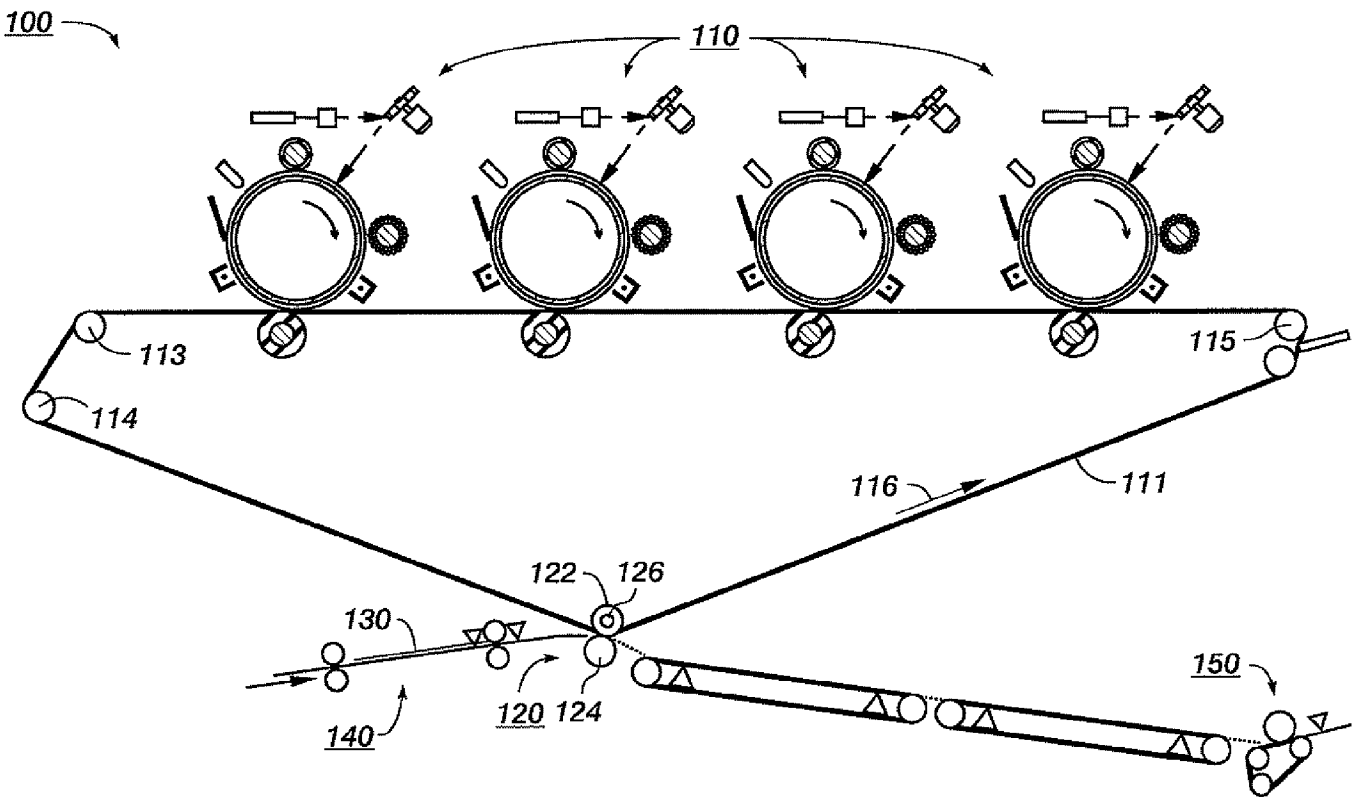
FIG. 1 is a schematic representation of a xerographic apparatus in which embodiments may be employed.

FIG. 1 is a schematic of an exemplary xerographic apparatus 100. Although embodiments will be described with reference to the embodiment shown in the drawings, it should be understood that embodiments may be employed in many alternate forms. In addition, any suitable size, shape or type of elements or materials could be used without departing from the spirit of the invention.

As shown in FIG. 1, the xerographic apparatus 100 may include at least one image forming apparatus 110, each of substantially identical construction, that may apply a color of toner (or black). In the example of FIG. 1, there are four image forming apparatus, or imaging apparatus, 110 which may apply, for example, cyan, magenta, yellow, and/or kappa/black toner, respectively. The image forming apparatus 110 may apply toner to an intermediate transfer belt 111. The intermediate transfer belt 111 may be mounted about at least one tensioning roller 113, steering roller 114, and drive roller 115. As the drive roller 115 rotates, it moves the intermediate transfer belt 111 in the direction of arrow 116 to advance the intermediate transfer belt 111 through the various processing stations disposed about the path of the belt 111. Once the toner image has been completed on the belt 111 by having toner deposited, if appropriate, by each imaging apparatus 110, the complete toner image is moved to the transfer station 120. The transfer station 120 may transfer the toner image to paper or other media 130 carried to the transfer station by transport system 140. The media may then pass through a fusing station 150 to fix the toner image on the media 130. Many xerographic printers 100 use at least one biased transfer roller 124 for transferring imaged toner to sheet-type media 130 as shown and according to embodiments, though it should be understood that embodiments can be employed with continuous rolls of media or other forms of media without departing from the broader aspects of embodiments. U.S. Pat. No. 3,781,105, the disclosure of which is hereby incorporated by reference, discloses some examples of a biased transfer roller that can be used in a xerographic printer.

As shown in FIG. 1, the transfer station 120 may include at least one backup roller 122 on one side of the intermediate transfer belt 111. The backup roller 122 may form a nip on the belt 111 with a biased transfer roller 124 so that media 130 passes over the transfer roller 124 in close proximity to or in contact with the complete toner image on the intermediate transfer belt 111. The transfer roller 124 may act with the backup roll 122 to transfer the toner image by applying high voltage to the surface of the transfer roller 124, such as with a steel roller. The backup roller 122 may be mounted on a shaft 126 that may be grounded, which creates an electric field that pulls the toner image from the intermediate transfer belt 111 onto the substrate 130. The sheet transport system 140 then directs the media 130 to the fusing station 150 and on to a handling system, catch tray, or the like (not shown).

Alternatively, in embodiments the backup roller 122 may be mounted on a shaft that is biased. As described above, the biased transfer roller 124 may be mounted on a shaft 126 that may be grounded, which creates an electric field that pulls the toner image from the intermediate transfer belt 111 onto the substrate 130. Alternatively, the shaft of the backup roller 122 may be biased while the shaft 126 on the biased transfer roller 124 may be grounded. The sheet transport system 140 may then direct the media 130 to the fusing station 150 and on to a handling system, catch tray, or the like (not shown).

Figure 2:
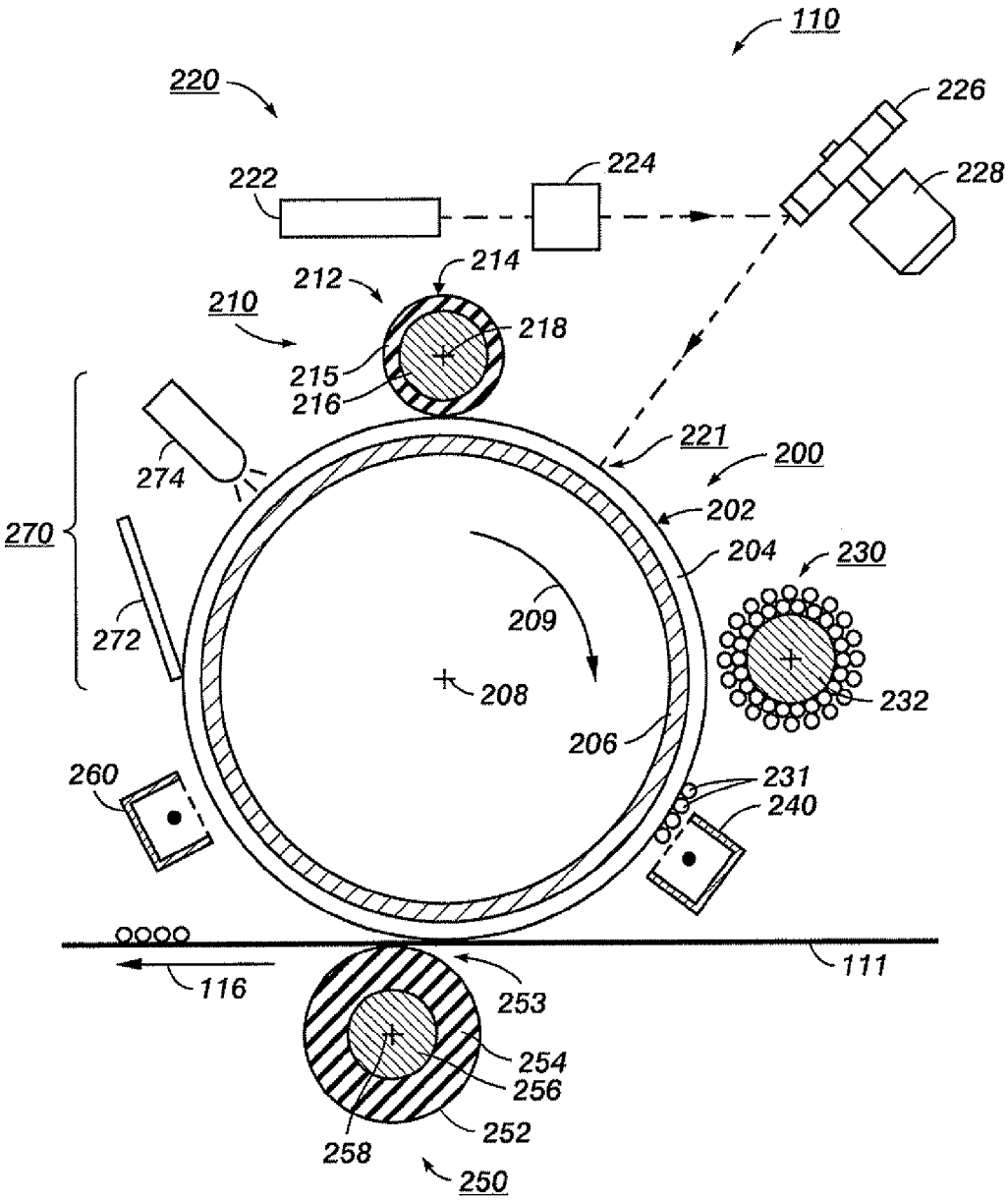
FIG. 2 is a schematic of an imaging apparatus in which embodiments may be employed, the imaging apparatus being part of a xerographic apparatus, such as that shown in FIG. 1.

FIG. 2 is a schematic of an imaging apparatus, such as the imaging apparatus 110 that is shown in FIG. 1. As shown in FIG. 2, each image forming apparatus 110 may include a photoreceptor 200, a photoreceptor charging station or subsystem 210, a laser scanning device or subsystem 220, such as a rasterizing output scanner, a toner deposition station or subsystem 230, a pretransfer station or subsystem 240, a transfer station or subsystem 250, a precleaning station or subsystem 260, and a cleaning/erase station 270. Although the photoreceptor 200 embodiment shown is a drum, other forms of photoreceptor may be used. The photoreceptor drum 200 may include a surface 202 of a photoconducting layer 204 on which an electrostatic charge can be formed. The photoconducting layer 204 may be mounted or formed on a cylinder 206 that is mounted for rotation on a shaft 208, such as in the direction of the arrow 209.

Figure 3:
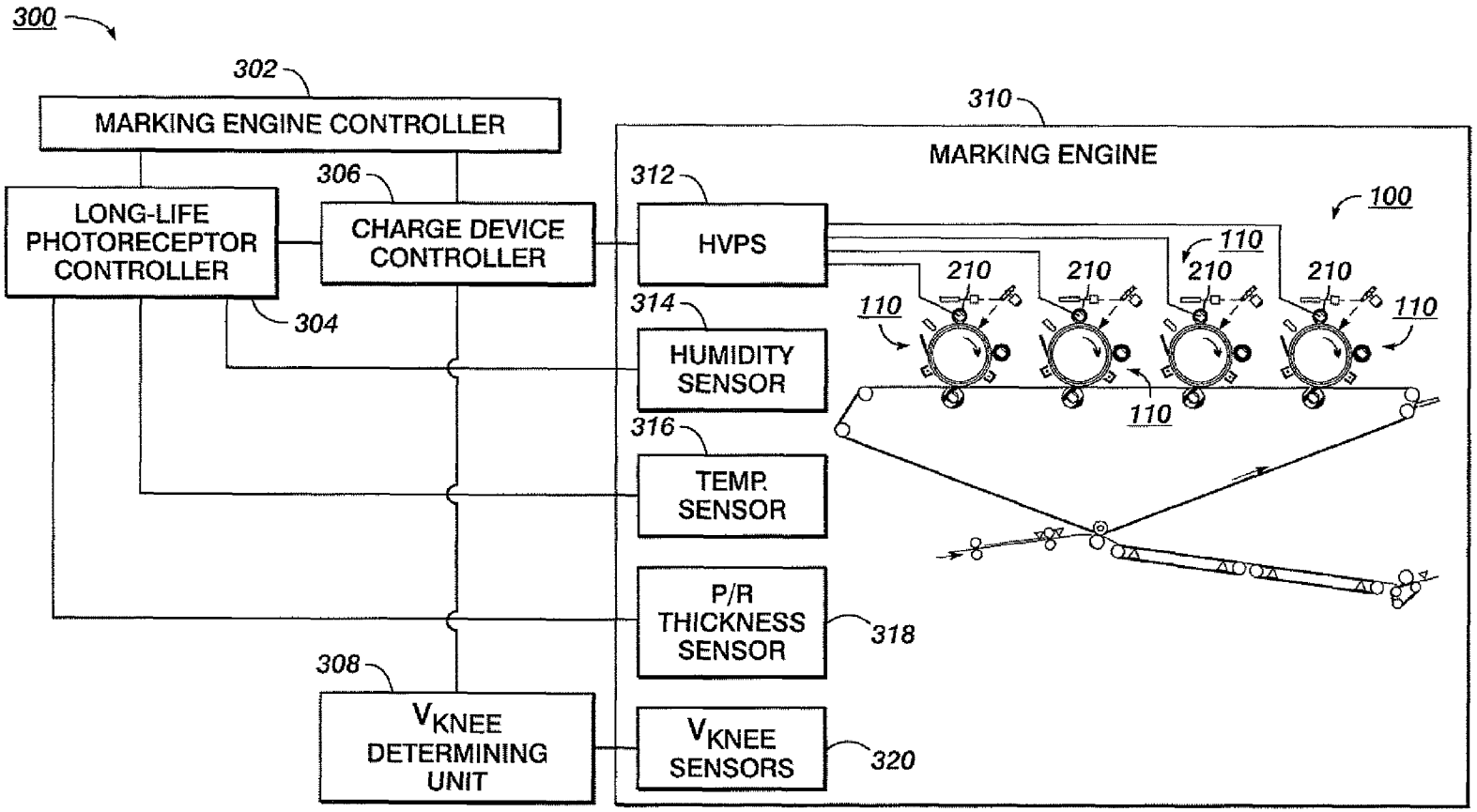
FIG. 3 is a system level schematic of a xerographic system that incorporates the exemplary xerographic apparatus of FIG. 1.

Photoreceptor charging station 210 may include a biased charging roller 212 that charges the photoreceptor 200 using a DC-biased AC voltage supplied by a high voltage power supply (shown in FIG. 3). The biased charging roller 212 may include a surface 214 of an elastomeric layer 215 formed or mounted on an inner cylinder 216, such as a steel cylinder, though any appropriate conducting material could be used. The roller 212 may be mounted for rotation with a shaft 218 extending therethrough along a longitudinal axis of the roller 212.

The laser scanning device 220 of embodiments may include a controller 222 that modulates the output of a laser 224, such as a diode laser, whose modulated beam shines onto a rotating mirror or prism 226 rotated by a motor 228. The mirror or prism 226 reflects the modulated laser beam onto the charged PC surface 202, panning it across the width of the PC surface 202 so that the modulated beam can form a line 221 of the image to be printed on the PC surface 202. Exposed portions of the image to be printed move on to the toner deposition station 230, where toner 232 may adhere to the exposed regions of the photoconductor. The image regions of the PC, with adherent toner, then pass to the pretransfer station 240 and on to the transfer station 250.

The transfer station 250 may include a biased transfer roller 252 arranged to form a nip 253 on the intermediate transfer belt 111 for transfer of the toner image onto the intermediate transfer belt 111. In embodiments, the biased transfer roller 252 includes an elastomeric layer 254 formed or mounted on an inner cylinder 256, and the roller 252 is mounted on a shaft 258 extending along a longitudinal axis of the roller 252. The biased transfer roller 252 may carry a DC potential provided by a high voltage power supply, such as that shown in FIG. 3. The voltage applied to the roller 252 draws the toner image 231 from the photoreceptor surface 202 to the intermediate transfer belt 111. After transfer, the PC surface 202 rotates to the precleaning subsystem 260, then to the cleaning/erasing substation 270, where a blade 272 scrapes excess toner from the PC surface 202 and an erase lamp 274 equalizes the residual charge on the PC surface.

FIG. 3 is a system level schematic of a xerographic printer system that incorporates the exemplary xerographic apparatus of FIG. 1. As shown in FIG. 3, an exemplary xerographic printer system 300 may include a marking engine controller 302, a long-life P/R controller 304, a charge device controller 306, a $V_{KNEE}$ determining unit 308, and a marking engine 310. Marking engine 310 may include a high voltage power supply 312, a humidity sensor 314, a temperature sensor 316, photoreceptor thickness sensors 318, $V_{KNEE}$ sensors 320, and a xerographic apparatus 100, such as the example xerographic apparatus described with respect to FIG. 1, above.

As shown in FIG. 3, marking engine controller 302 may communicate with long-life P/R controller 304, charge device controller 306, and marking engine 310. Long-life P/R controller 304 may communicate with humidity sensor 314, temperature sensor 316, and photoreceptor thickness sensor 318. Charge device controller 306 may communicate with $V_{KNEE}$ determining unit 308 and high voltage power supply 312, $V_{KNEE}$ determining unit 308 may communicate with $V_{KNEE}$ sensors 320, and high voltage power supply 312 may provide high voltage signals to the photoreceptor charging station 210 of each imaging apparatus 110 included in xerographic apparatus 100.

In operation, marking engine controller 302 may control and monitor the operation of numerous subsystems and operations performed by xerographic printer system 300, in addition to those units shown in FIG. 3. For example, in response to stored parameters and input received via a user interface, marking engine controller 302 may control and monitor the execution of print jobs executed by xerographic printer system 300, including providing marking engine 310 with data to drive laser scanning subsystem 220 included in each xerographic apparatus 100. Further, marking engine controller 302 may communicate with marking engine 310 to monitor the progress of executed jobs and may receive and store status information from marking engine 310. In addition, marking engine controller 302 may maintain configuration data related to the type, age, and condition of components within marking engine 310.

Charge device controller 306 may periodically receive from $V_{KNEE}$ determining unit 308, for each imaging apparatus 110 in marking engine 310, a $V_{KNEE}$ value for the photoreceptor charge curve of the photoreceptor within each imaging apparatus 110. Further, charge device controller 306 may receive from long-life photoreceptor controller 304 a $V_{PP}$-$V_{KNEE}$ value, as described below, for the photoreceptor within each imaging apparatus in marking engine 310. Charge device controller 306 may combine, the received $V_{KNEE}$ value with the received $V_{PP}$-$V_{KNEE}$ to generate an AC charging actuator value, $V_{PP}$, for each imaging apparatus in marking engine 310. Charge device controller 306 may transmit the derrived $V_{PP}$ values to high voltage power supply 312 which may then provide the respective charging stations 210 of each imaging apparatus 110, with an AC peak-to-peak voltage that is sufficiently high to avoid print quality defects yet minimizes photoreceptor wear, i.e., maximizes photoreceptor life, under the current operational environment conditions.

$V_{KNEE}$ determining unit 308 may receive sensor data from at least one $V_{KNEE}$ sensor 320 associated with each imaging apparatus 110 and may determine a charge curve $V_{KNEE}$ value for the photoreceptor of each imaging apparatus 110. $V_{KNEE}$ determining unit 308 may use any $V_{KNEE}$ determining technique, including, but not limited to, techniques described above with respect to U.S. patent application Ser. No. 11/644,276 (application '276), U.S. Pat. No. 6,611,665 to DiRubio et al., (patent '665), U.S. patent application Ser. No. 11/623,361 (application '361) which are incorporated herein by reference in their entirety. $V_{KNEE}$ sensors 320 may be any type of sensor that provides $V_{KNEE}$ determining unit 308 with sufficient information to determine a charge curve $V_{KNEE}$ value for each imaging apparatus photoreceptor. $V_{KNEE}$ sensors 320 may include, but are not limited to, those sensors described with respect to application '276, patent '665 and application '361.

Long-life photoreceptor controller 304 may monitor environmental sensors included within marking engine 310, e.g., relative humidity sensor 314 and temperature sensor 316, and may determine a $V_{PP}$-$V_{KNEE}$ vale for the photoreceptor within each imaging apparatus 110. Long-life photoreceptor controller 304 may determine a $V_{PP}$-$V_{KNEE}$ value for the photoreceptor based on any number of factors, including but not limited to, the type of photoreceptor in use, the ambient temperature, the ambient relative humidity, the temperature within the xerographic apparatus 100, the relative humidity within the xerographic apparatus 100, and the determined thickness of the photoconductor. Long-life photoreceptor controller 304 may provide the determined $V_{PP}$-$V_{KNEE}$ value to charge device controller 306 for use in determining an AC charging actuator value, $V_{PP}$, for each imaging apparatus in marking engine 310.

In one example embodiment, long-life photoreceptor controller 304 may check the data received from temperature sensor 316 and relative humidity sensor 314 to determine whether xerographic printer system 300 is operating in an A-zone environment. If xerographic printer system 300 is determined to be operating in an A-zone environment, long-life photoreceptor controller 304 may select a higher predetermined $V_{PP}$-$V_{KNEE}$ value that assures that the photoconductor will wear at a rate greater than 5 nm/kilo-cycle so that contaminants do not build up and eventually lead to LCM print quality failure. If xerographic printer system 300 is determined not to be operating in an A-zone environment, long-life photoreceptor controller 304 may select a lower predetermined $V_{PP}$-$V_{KNEE}$ value that assures that the photoconductor will wear at a rate sufficiently high to avoid print quality defects yet minimizes photoreceptor wear, i.e., maximizes photoreceptor life.

In one example embodiment, long-life photoreceptor controller 304 may be provided by marking engine controller 302 with pre-calculated tables applicable to the type of photoreceptors used in marking engine 300. Such tables may provide predetermined optimal $V_{PP}$-$V_{KNEE}$ values, e.g., based on prior testing for the specific type of photoreceptor in use, for each temperature within a predetermined range of temperatures, and/or may provide predetermined optimal $V_{PP}$-$V_{KNEE}$ values for each relative humidity within a predetermined range, and/or may provide predetermined optimal $V_{PP}$-

$V_{KNEE}$ values for each temperature/relative humidity pair across an range of temperature/relative humidity pairs.

In one example embodiment, long-life photoreceptor controller 304 may be provided by marking engine controller 302 with an algorithm or function, e.g., specifically tailored to the type of photoreceptors used in marking engine 300 based on prior experiments and regression analysis, that allows long-life photoreceptor controller 304 to retrieve a $V_{PP}$-$V_{KNEE}$ value based on temperature and humidity values provided by long-life photoreceptor controller 304. Such algorithms may serve a function similar to that of the tables, described above, but may require less storage space.

In one example embodiment, each imaging apparatus 110 may include a sensor that measures the thickness of the photoconductor and provides the measure of photoconductor thickness to long-life photoreceptor controller 304. For example, as described below with respect to FIG. 12, a thinner photoreceptor may obtain the same charge as a thicker photoreceptor at a lower $V_{PP}$-$V_{KNEE}$ value. Long-life photoreceptor controller 304 may maintain tables and/or algorithms that allow a $V_{PP}$-$V_{KNEE}$ value determined for a given temperature/relative humidity to be adjusted to accommodate observed wear on the photoreceptor.

In one example embodiment, long-life photoreceptor controller 304 may estimate a thickness of each photoreceptor based on such factors as, for example, the age of the photoconductor, the number of pages processed by the photoconductor, etc. For example, as described below with respect to FIG. 12, a thinner photoreceptor may obtain the same charge as a thicker photoreceptor at a lower $V_{PP}$-$V_{KNEE}$ value. Long-life photoreceptor controller 304 may maintain tables and/or algorithms that allow a $V_{PP}$-$V_{KNEE}$ value determined for a given temperature/relative humidity to be adjusted based on the estimated photoconductor thickness. For example, in one example embodiment, long-life photoreceptor controller 304 may request page count data from marking engine controller 302 each time a new $V_{PP}$-$V_{KNEE}$ value is provided to charge device controller 306, and may receive $V_{KNEE}$ values from charge device controller 306. In this manner, long-life photoreceptor controller 304 may determine how many cycles were performed at each AC charging actuator value, $V_{PP}$, for each photoreceptor, and may therefore determine a change in the thickness of the photoconductor based on algorithms/tables based on establish photoreceptor wear data, as described below with respect to FIG. 8, FIG. 9, and FIG. 10.

It is noted that FIG. 3 is a system level schematic, only, and is not intended to reflect the actual physical location of the respective environmental and other sensors. For example, humidity sensor 314, temperature sensor 316, $V_{KNEE}$ sensors 320, and optional photoreceptor thickness sensor 318 may be placed anywhere within marking engine that allows the respective sensors to accurately acquire the data that each is intended to acquire. Such locations may vary depending on the type of sensor, and in the case of $V_{KNEE}$ sensors 320, and optional photoreceptor thickness sensor 318, may depend on the imaging apparatus 110 for which the sensors are intended to obtain data.

Figure 4:
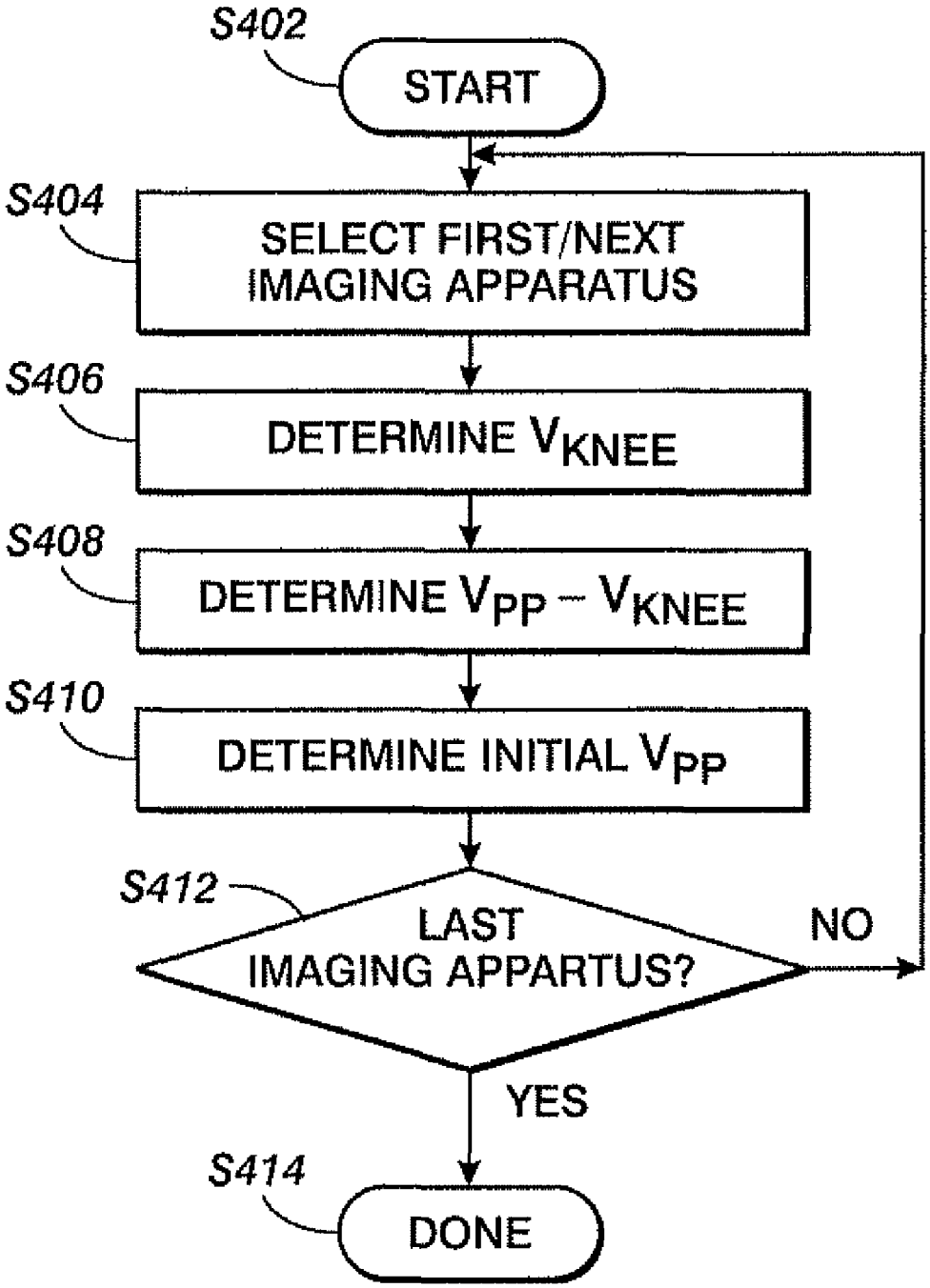
FIG. 4 is a flowchart illustrating an exemplary method for determining initial AC charging actuator values for the exemplary xerographic system of FIG. 3.

FIG. 4 is a flowchart illustrating of an exemplary method for determining initial AC charging actuator values each imaging apparatus within the exemplary xerographic system of FIG. 3. As shown in FIG. 4, operation of the method begins at step S402 with the startup of a xerographic printer and proceeds to step S404.

In step S404, the first/next imaging apparatus in the xerographic system is selected, and operation of the method continues to step S406.

In step S406, $V_{KNEE}$ determining unit 308 may determine an initial $V_{KNEE}$ value for the photoreceptor charge curve, for example, using one or more techniques described in application '276, patent '665 and application '361, which have been incorporated by reference in their entirety into the present application, and operation of the method continues to step S408.

In step S408, long-life photoconductor controller 304 may determine an initial $V_{PP}$-$V_{KNEE}$ value for the photoreceptor using one or more of the exemplary techniques described, above, with respect to FIG. 3, and operation of the method continues to step S410.

In step S410, charge device controller 306 determines an actuator value, $V_{PP}$, by combining the determined initial $V_{KNEE}$ value with the determined initial $V_{PP}$-$V_{KNEE}$ value, and operation of the method continues to step S412.

If, in step S410, it is determined that the last imaging apparatus has not yet been selected and, therefore, that an initial actuator value, $V_{PP}$, has not been determined for every imaging apparatus in the xerographic system, operation of the method continues to step S404, otherwise, operation of the method continues to step S414, and the method terminates.

Figure 5:
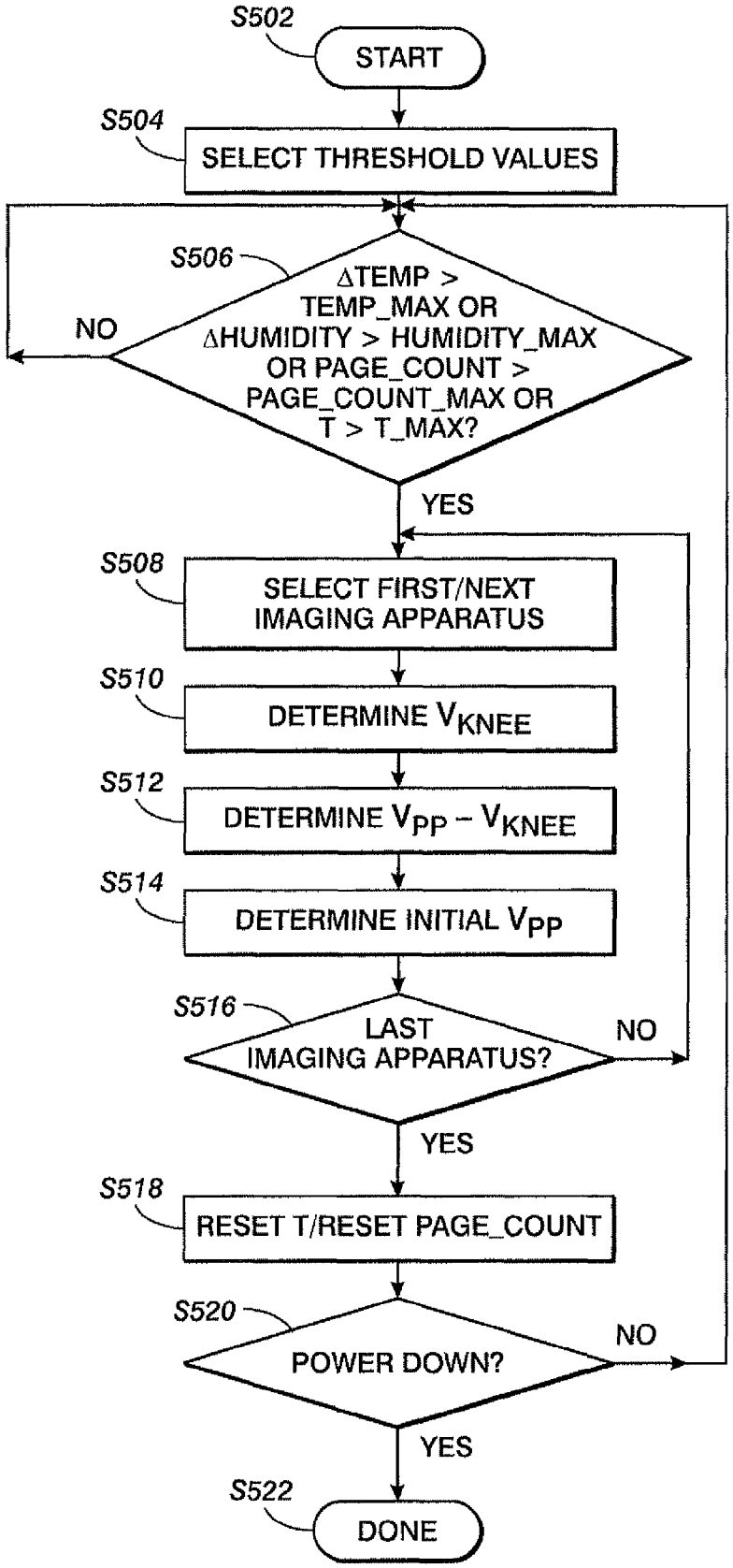
FIG. 5 is a flowchart illustrating an exemplary method for maintaining AC charging actuator values for the exemplary xerographic system of FIG. 3.

FIG. 5 is a flowchart illustrating of an exemplary method for maintaining AC charging actuator values for photoconductors within imaging apparatus within the exemplary xerographic system of FIG. 3. As shown in FIG. 5, operation of the method begins at step S502 with the startup of a xerographic printer and proceeds to step S504.

In step S504, threshold parameters of various types that maybe used to control when a new set of actuator values should be generated are initialized, and operation of the method continues to step S506.

If, in step S506, one of the threshold hold parameters is exceeded, for example, a maximum page count (page_count_max) has been exceeded, or a maximum time (T_max) has elapsed, or a maximum change in the temperature (temp_max) of the operational environment has occurred, or a maximum change in the relative humidity (humidity_max) of the operational environment has occurred since the last set of actuator value were determined, operation of the method continues to step S508, otherwise, operation of the method remains at step S506.

In step S508, the first/next imaging apparatus in the xerographic system is selected, and operation of the method continues to step S510.

In step S510, $V_{KNEE}$ determining unit 308 may determine an initial $V_{KNEE}$ value for the photoreceptor charge curve, for example, using one or more techniques described in application '276, patent '665 and application '361, which have been incorporated by reference in their entirety into the present application, and operation of the method continues to step S512.

In step S512, long-life photoconductor controller 304 may determine an initial $V_{PP}$-$V_{KNEE}$ value for the photoreceptor using one or more of the exemplary techniques described, above, with respect to FIG. 3 and operation of the method continues to step S514.

In step S514, charge device controller 306 determines an actuator value, $V_{PP}$, by combining the determined initial $V_{KNEE}$ value with the determined initial $V_{PP}$-$V_{KNEE}$ value, and operation of the method continues to step S516.

If, in step S516, it is determined that the last imaging apparatus has not yet been selected and, therefore, that an initial actuator value, $V_{PP}$, has not been determined for every imaging apparatus in the xerographic system, operation of the method continues to step S508, otherwise, operation of the method continues to step S518.

In step S518, a clock time, T, used to measure elapsed time since the last set of actuator value were determined, and a page counter, page_count, used to store a number of pages that have been processed since the last set of actuator values were determined, may be reset, and operation of the method continues to step S520.

If, in step S520, it is determined that a power down of the xerographic system has been requested, operation of the method continues to step S522, and the method terminates, otherwise, operation of the method continues to step S506.

Figure 6:
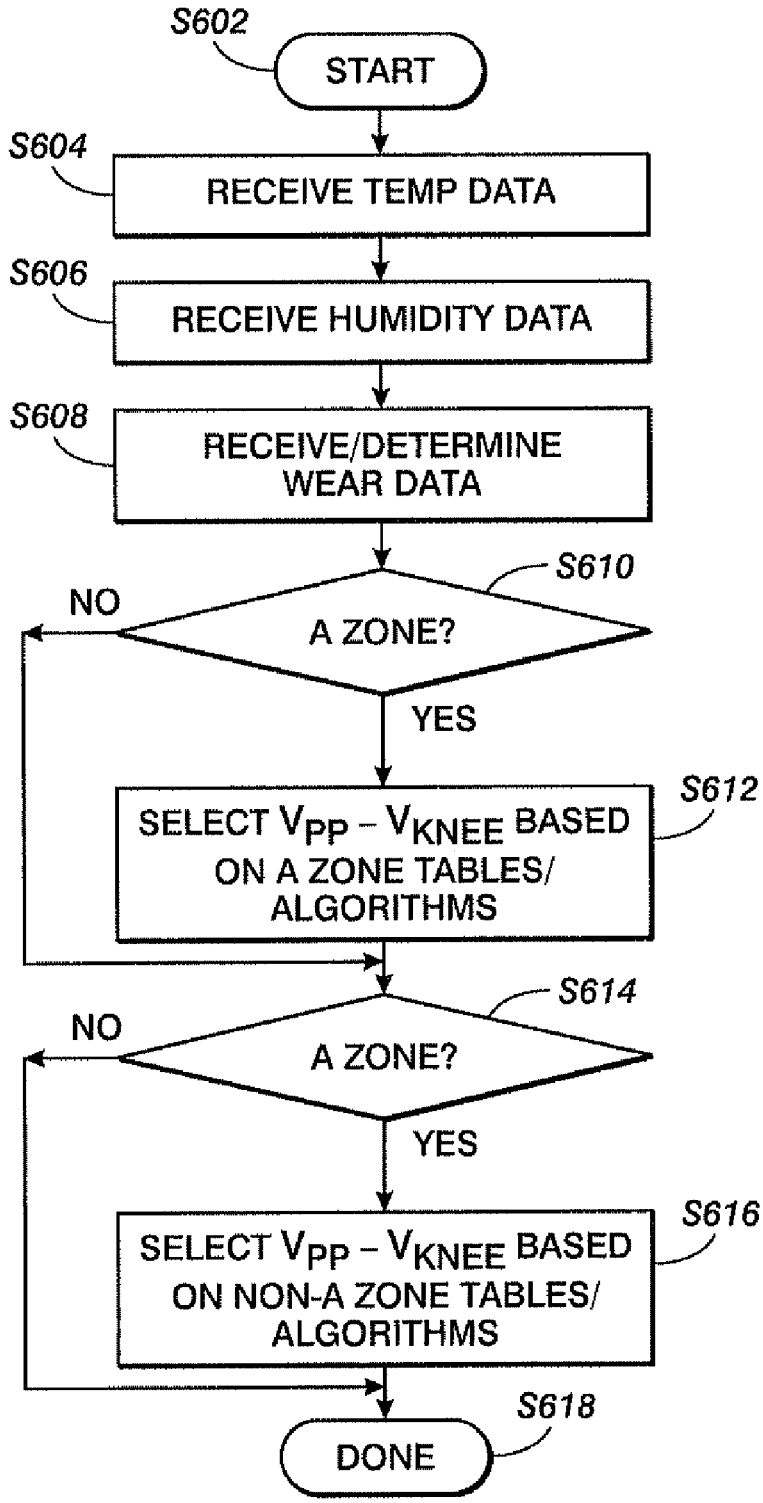
FIG. 6 is a flowchart illustrating an exemplary method for determining a $V_{PP}$-$V_{KNEE}$ value for the exemplary xerographic system of FIG. 3.

FIG. 6 is a flowchart illustrating of an exemplary method for determining a $V_{PP}$-$V_{KNEE}$ value for the photoconductor of an imaging apparatus within the exemplary xerographic system of FIG. 3. The method described below may be executed at step S408 and at step S512, described above with respect to FIG. 4 and FIG. 5, respectively, and may be performed, for example, by the long-life photoreceptor controller 304, described above with respect to the exemplary xerographic system described with respect to FIG. 3. As shown in FIG. 6, operation of the method begins at step S602 with the startup of a xerographic printer and proceeds to step S604.

In step S604, the long-life photoreceptor controller may receive environment temperature data for a currently selected imaging apparatus, and operation of the method continues to step S606.

In step S606, the long-life photoreceptor controller may receive operation environment relative humidity data for a currently selected imaging apparatus, and operation of the method continues to step S608.

In step S608, the long-life photoreceptor controller may receive photoreceptor wear data, and/or data that may be used to estimate photoreceptor wear, as described above with respect to FIG. 3, and operation of the method continues to step S610.

If, in step S610, based on received temperature and/or humidity data, the long-life photoreceptor controller determines that the xerographic system is operating in an A-zone environment, operation of the method continues to step S612, otherwise, operation of the method continues to step S614.

In step S612, the long-life photoreceptor controller may select a $V_{PP}$-$V_{KNEE}$ value based on A-zone tables and/or A-zone algorithms, as described above with respect to FIG. 3, and operation of the method continues to step S614.

If, in step S614, based on received temperature and/or humidity data, the long-life photoreceptor controller determines that the xerographic system is not operating in an A-zone environment, operation of the method continues to step S616, otherwise, operation of the method continues to step S618 and the method terminates.

In step S616, the long-life photoreceptor controller may select a $V_{PP}$-$V_{KNEE}$ value based on non-A-zone tables and/or non-A-zone algorithms, as described above with respect to FIG. 3, and operation of the method continues to step S618 and the method terminates.

The process described above with respect to FIG. 4 may be repeated periodically by the marking engine controller until the xerographic system is powered down. Intervals between execution of the above process to update the charging setpoint may be controlled based on threshold values that may be user configurable values and/or may be dynamically updated based on lookup tables which provide such thresholds based upon such factors as the type, or model of photoconductor and/or age of the photoconductor and/or other factors monitored by the xerographic printer marking engine controller.

Figure 7:
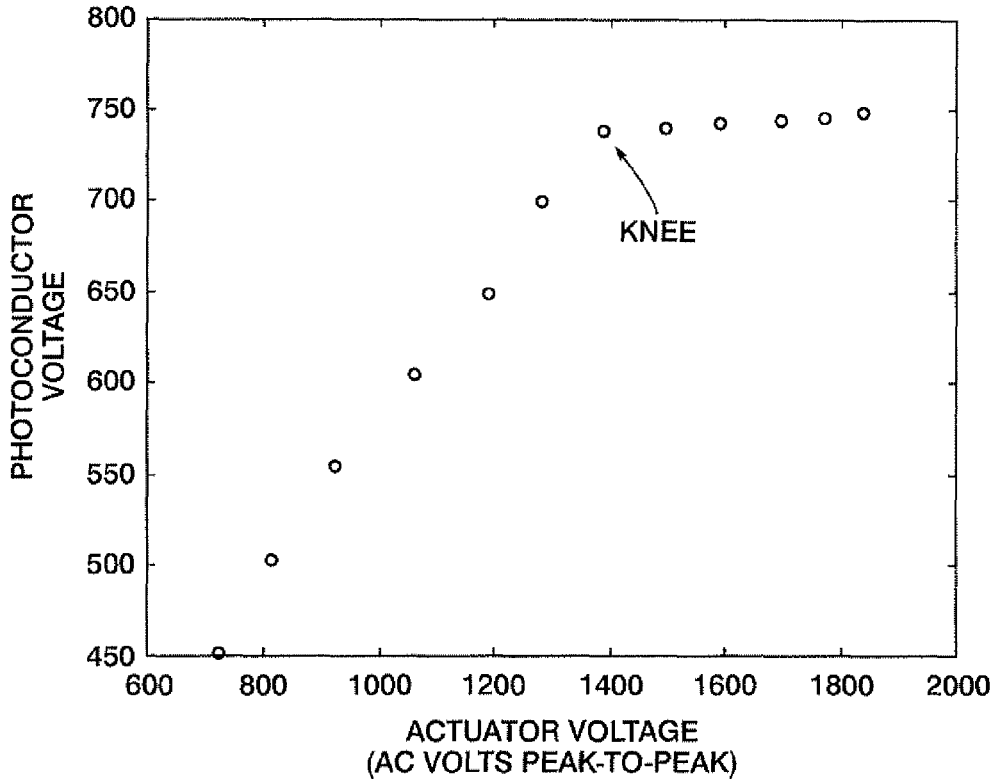
FIG. 7 is a plot of measured photoconductor surface voltages generated in response to various AC charging actuator values applied by an AC-biased charging device.

FIG. 7 is a plot of measured photoconductor surface voltages generated in one example of a photoconductor in response to a sweep of bias charging device AC charging actuator values. Specifically, FIG. 7 presents a voltage measured on a photoconductor, on the y-axis, as a function of an AC peak-to-peak voltage signal supplied to a photoreceptor charging station used to place the measured charge on the photoconductor. The data presenting in FIG. 7 was obtained by sweeping the charging station AC peak-to-peak voltage and measuring the photoconductor surface voltage ($V_{charge}$) with an electrostatic voltmeter sensor.

As seen in FIG. 7, a plot of the photoconductor surface voltage initially increases linearly with the applied AC charging actuator values and then becomes asymptotic beyond a point that is identified as the "knee." For reasons addressed above, to avoid print defects, the AC charging actuator value chosen for use to generate printed pages should be greater than the AC charging actuator value at the charge curve knee. As described above, an appropriate AC charging actuator value for a photoconductor may be determined by determining a charging curve knee value, $V_{KNEE}$, for the photoconductor and adding to the $V_{KNEE}$ value a $V_{PP}$-$V_{KNEE}$ value which may be determined based on a wide variety factors, which may include the temperature and relative humidity of the environment in which the xerographic system is operating.

Figure 8:
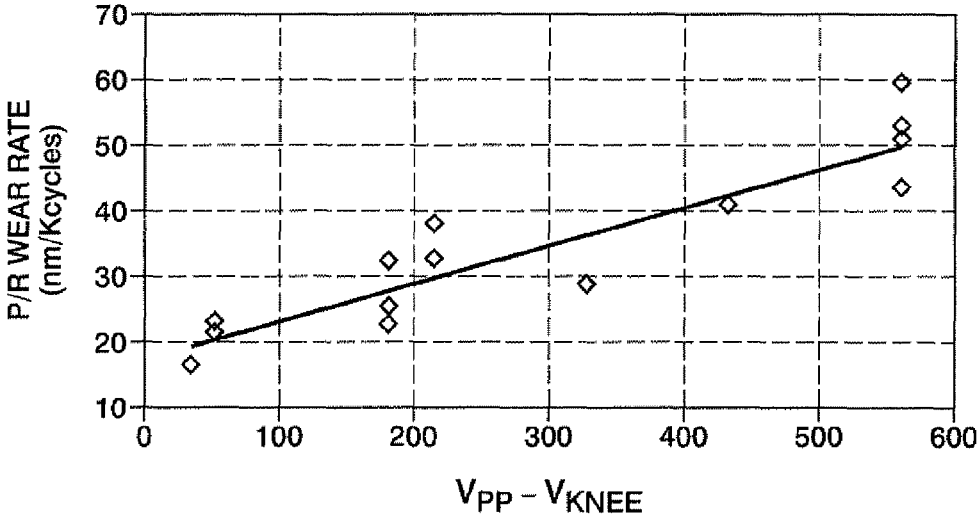
FIG. 8 is a plot of measured photoreceptor wear rate for an uncoated photoreceptor in response to different AC charging actuator values.

FIG. 8 is a plot of measured photoreceptor wear rate for one example of an uncoated photoreceptor in response to different AC charging actuator values. Specifically, FIG. 8 is a plot of the relationship between the Vpp actuator value and the wear rate of the photoreceptor of a Phaser 7750 print engine. As shown in FIG. 8, in the case of a non-overcoated photoconductor drum charged with a BCR charger and cleaned with a blade cleaner, wear rate may be reduced from approximately 45 nm/kilo-cycle to approximately 23 nm/kilo-cycle using such intelligent Vpp actuator value selection processes, such as those described above, thereby increasing photoconductor life without increasing print quality defects.

Figure 9:
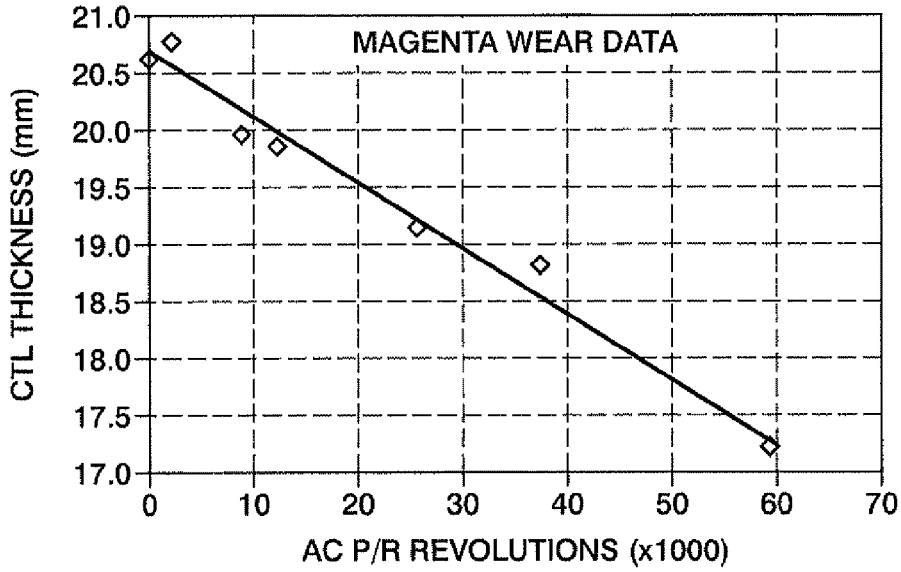
FIG. 9 is a plot of measured photoreceptor drum wear data for a photoreceptor coated with a 4 um protective overcoating.

FIG. 9 is a plot of measured photoreceptor drum wear data for one example of a photoreceptor coated with a 4 um protective overcoating on top of the charge transport layer. This overcoat protects the CTL from excessive wear, thereby ensuring extended photoreceptor life. Recent experiments have shown wear rates as low as approximately 6 nm/kilo-cycle for such an overcoated photoreceptor drum with a BCR charger and a blade cleaner, operated under nominal BCR conditions. As shown in FIG. 9, at such a wear rate, such an a photoreceptor with a 4 μm overcoat may be expected to last an estimated 650 k cycles.

Figure 10:
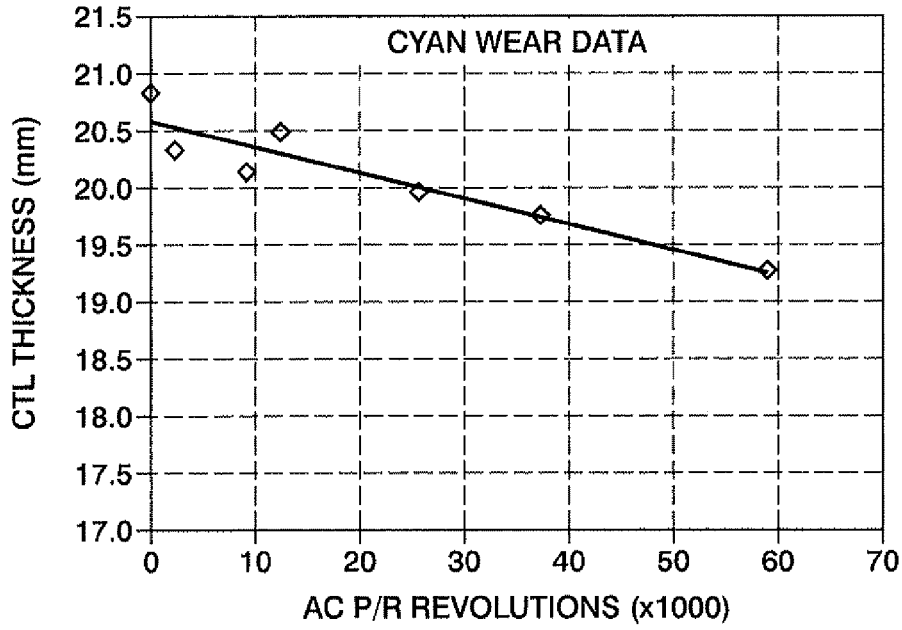
FIG. 10 is a plot of measured photoreceptor drum wear data for a photoreceptor coated with a 4 um protective overcoating in a system using a dynamic controls to optimally reduce the applied AC peak-to-peak driving voltage.

FIG. 10 is a plot of measured photoreceptor drum wear data for one example of a photoreceptor coated with a 4 um protective overcoating in a system using a dynamic controls to optimally reduce the applied charging actuator AC peak-to-peak driving voltage. Recent experiments have shown that the combination of the overcoat and AC charging actuator charge control approaches may lead to even lower wear rates, on the order of 3 nm/kilo-cycle. For a photoreceptor drum with an overcoat of 4 um thickness, this would equate to an expected life of approximately 1.3 million cycles for the photoreceptor. This would be a substantial life improvement for most photoreceptors operating with BCR charging systems.

Figure 11:
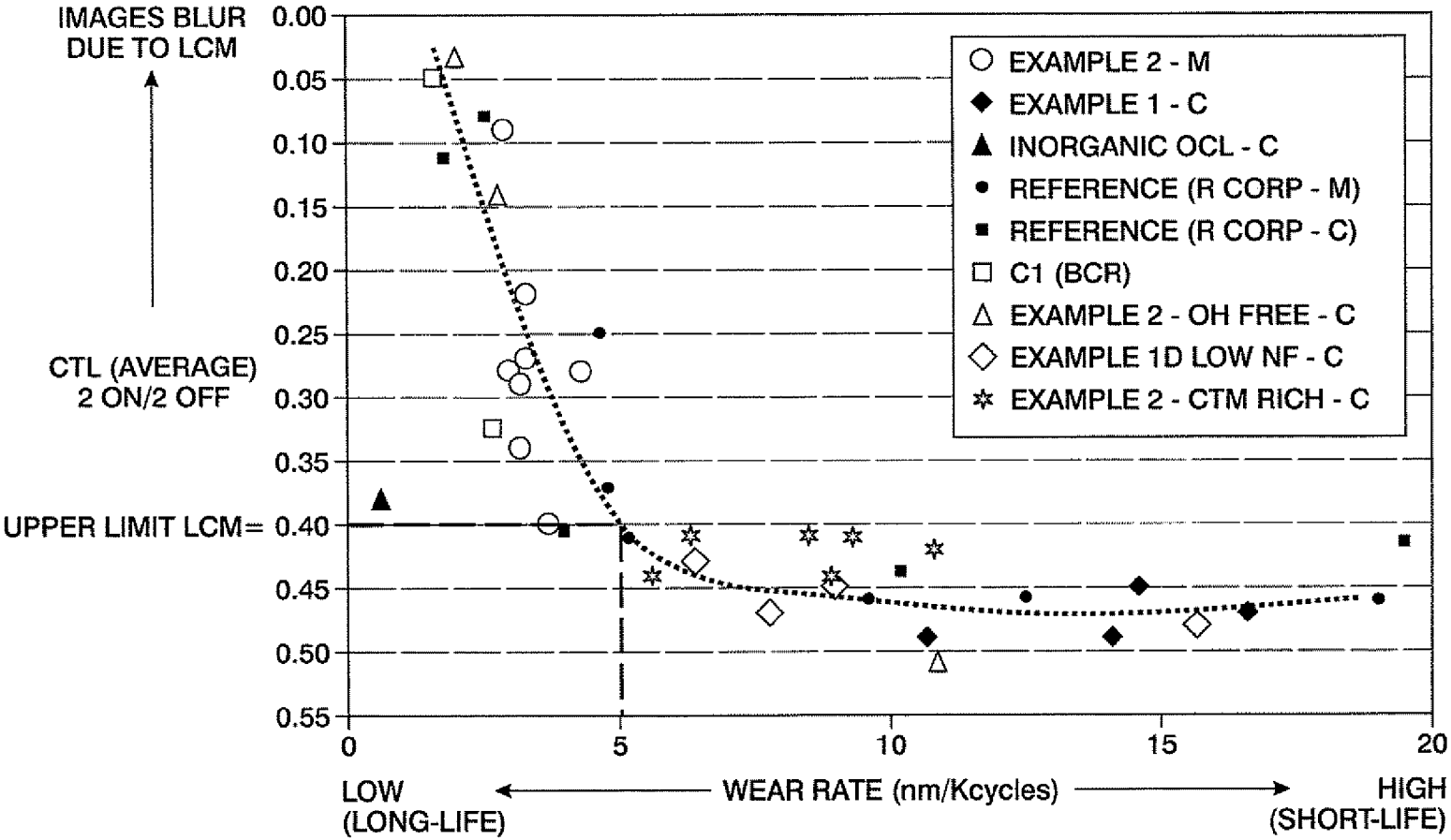
FIG. 11 is a plot of the relationship between photoreceptor wear rate and lateral charge migration image quality in A-zone conditions.

FIG. 11 is a plot of the relationship between photoreceptor wear rate and lateral charge migration image quality in A-zone conditions for example photoreceptors. As described above, the extremely low wear rates achieved for the overcoated drums with the dynamic controls to optimally reduce the applied charging actuator AC peak-to-peak driving voltage predicts a photoreceptor life in excess of 1 million cycles, with a 4 um coating. Unfortunately, as described above, a problem occurs for a photoreceptor operated in A-zone, i.e., hot and humid, environments at these low wear rates. Under such operating conditions, a film may build up on the surface of the photoreceptor. This film may eventually leads to lateral charge migration (LCM) related print defects.

The resolution of the final print depends heavily on the location of the electrostatic charge upon the imaging surface of the photoconductive insulating layer. Lateral charge migration (LCM), i.e. the movement of charges on or near the surface of an almost insulating photoconductor surface, has the effect of smoothing out the spatial variations in the surface charge density profile of the latent image. It can be caused by a number of different substances or events (i.e., by ionic contaminants from the environment, by naturally occurring charging device effluents, etc.), which cause the charges to move. LCM can occur locally or over the entire photoconductor surface. As a result, some of the fine features present in the input image may not be present in the final print. This is usually referred to as wipeout or deletion. In order to prevent this from occurring, the P/R wear rate is typically maintained sufficiently high in the system such that the film cannot buildup. As shown in FIG. 11, experiments have indicated that 5 nm/kilo-cycle is the minimum threshold for photoreceptor wear to ensure that the LCM problem does not occur under A-zone environmental conditions.

Figure 12:
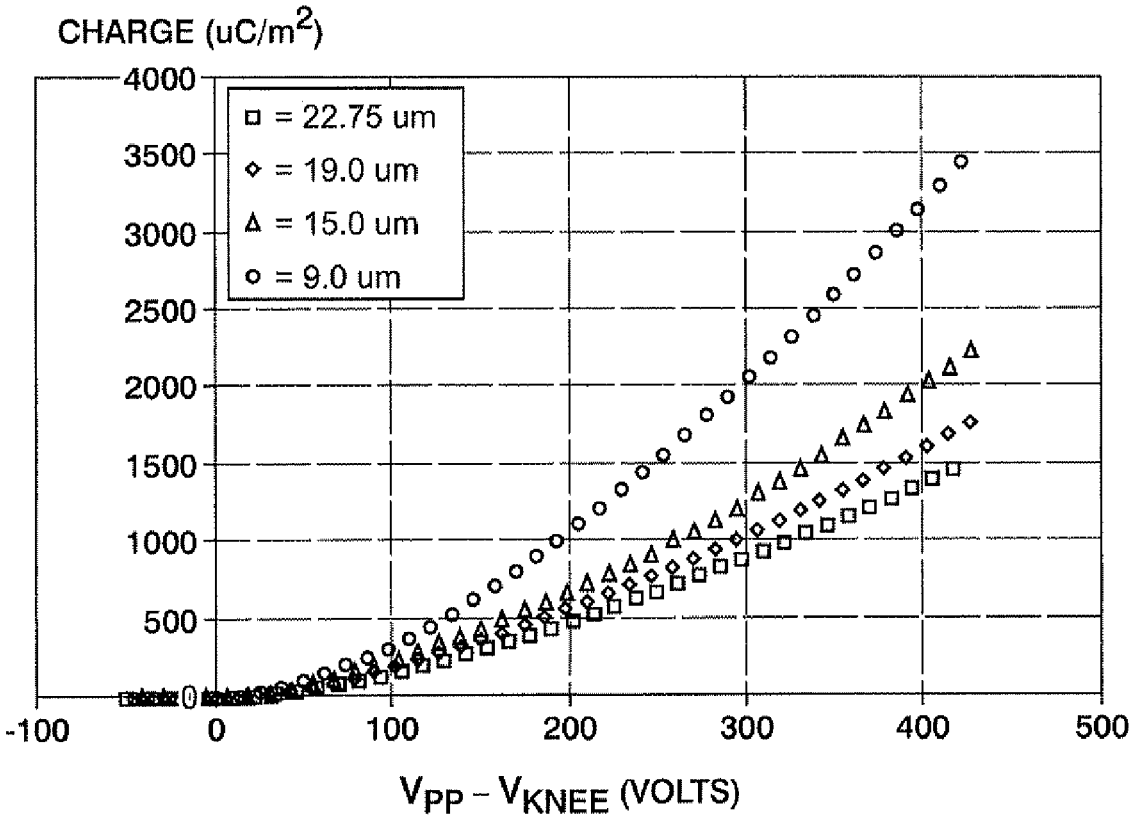
FIG. 12 is a plot of the positive charge deposited on the surface of the photoconductor as a function of AC charging actuator values equal to and greater than the AC charging actuator value corresponding to a knee in the photoconductor charging curve, for various photoconductor CTL thicknesses.

FIG. 12 is a plot of estimated positive charge deposition on the photoconductor surface as a function of AC charger actuator values greater than the knee in example photoconductors of various CTL thicknesses. As demonstrated by FIG. 12, positive charge deposition on the photoconductor rises dramatically for photoconductor surfaces of all thickness, but thinner photoconductors, e.g. approximately 9 um in thickness, are subject to an even greater increase in positive charge deposition than are thicker photoconductors. Higher positive charge deposition will increase the rate of deterioration of the respective photoconductors. Such deterioration will eventually result in print defects. Therefore, based upon the results presented in FIG. 12, the $V_{PP}$-$V_{KNEE}$ values used to obtain a $V_{KNEE}$ value for the photoconductor may be adjusted downward as the photoconductor wears and becomes thinner without reducing the charge obtained on the photoconductor, and without increasing the likelihood of print quality defects. As described above with respect to FIG. 3, a $V_{PP}$-$V_{KNEE}$ value obtained using tables and/or algorithms developed for a specific photoconductor under specific temperature and humidity conditions may be adjusted downward to accommodate estimated, or measured, wear on a photoconductor. Such adjustments relative to photoconductor wear may be based on tables and/or algorithms that capture the effect of photoconductor wear on the charge of a specific photoconductor, similar to the data presented in FIG. 12.

For example, based on the data presented in FIG. 12, assuming that a charge of 1000 $\mu C/M^2$ is desired on a photoconductor surface, if the photoconductor thickness is measured, or estimated to be 22.75 μm, a $V_{PP}$-$V_{KNEE}$ value of approximately 320 volts AC should be applied. However, if the photoconductor thickness is measured, or estimated to be 19 μm, a $V_{PP}$-$V_{KNEE}$ value of approximately 295 volts AC should be applied; if the photoconductor thickness is measured, or estimated to be 15 μm, a $V_{PP}$-$V_{KNEE}$ value of approximately 270 volts AC should be applied; and if the photoconductor thickness is measured, or estimated to be 9 μm, a $V_{PP}$-$V_{KNEE}$ value of approximately 195 volts AC should be applied. In such a manner, wear on the photoconductor may be minimized without increasing the risk of print quality defects. Once such wear data is obtained, for example, experimentally for a photoreceptor type, the data may be captured in either a table or algorithm, and may be used, for example, by the long-life photoreceptor controller, described above, to appropriately adjust $V_{PP}$-$V_{KNEE}$, as described above with respect to FIG. 3.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art which are also intended to be encompassed by the following claims.

What is claimed is:

1. A method of obtaining an AC charging actuator value, $V_{PP}$, for use during marking by a marking engine, the method comprising:

determining a knee value, $V_{KNEE}$, of a charge curve for a photoreceptor within an imaging apparatus of the marking engine;

measuring environment sensor data for the marking engine;

determining an offset value, $V_{PP}$-$V_{KNEE}$, based in part on the received environment sensor data; and determining an AC charging actuator value, $V_{PP}$, based on the determined knee value and the determined offset value.

2. The method of claim 1, wherein the AC charging actuator value is set higher than the knee value based on the offset value.

3. The method of claim 1, wherein the environment sensor data includes a temperature of the marking engine environment.

4. The method of claim 1, wherein the environment sensor data includes a relative humidity of the marking engine environment.

5. The method of claim 1, wherein the offset value is determined for a photoreceptor based on a temperature of the marking engine environment and a humidity of the marking engine environment.

6. The method of claim 1, further comprising:

determining a thickness of the photoreceptor.

7. The method of claim 1, wherein the offset value is determined based on a temperature of the marking engine environment, a humidity of the marking engine environment and a thickness of the photoreceptor.

8. The method of claim 1, wherein the offset value is selected to minimize photoreceptor wear.

9. The method of claim 1, wherein the offset value is selected to achieve a photoreceptor wear rate of at least 5 μm per one thousand cycles.

10. The method of claim 1, wherein the offset value is selected to achieve a photoreceptor wear rate of at least 5 μm per one thousand cycles and minimize photoreceptor wear based on the measured environment sensor data.

11. A xerographic marking engine control system, comprising:

a $V_{KNEE}$ determining unit that determines a knee value, $V_{KNEE}$, of a charge curve for an imaging apparatus photoreceptor within the xerographic system;

at least one environment sensor that provides environment sensor data;

a long-life photoreceptor controller that determines an offset value, $V_{PP}$-$V_{KNEE}$, based in part on the environment sensor data received from the at least one environment sensor; and a charge device controller that determines an AC charging actuator value, $V_{PP}$, based on the determined knee value and the determined offset value.

12. The xerographic marking engine control system of claim 11, wherein the charge device controller sets the AC charging actuator value higher than the knee value based on the offset value.

13. The xerographic marking engine control system of claim 11, further comprising:

a temperature sensor that provides a temperature of the marking engine environment, wherein the environment sensor data includes the temperature of the marking engine environment.

14. The xerographic marking engine control system of claim 11, further comprising:

a humidity sensor that provides a relative humidity of the marking engine environment, wherein the environment sensor data includes the relative humidity of the marking engine environment.

15. The xerographic marking engine control system of claim 11, wherein the long-life photoreceptor controller determines the offset value based on a temperature of the marking engine environment and a humidity of the marking engine environment.

16. The xerographic marking engine control system of claim 11, further comprising:

a photoreceptor thickness sensor that determines a thickness of the photoreceptor.

17. The xerographic marking engine control system of claim 11, wherein the long-life photoreceptor controller determines the offset value based on a temperature of the marking engine environment, a humidity of the marking engine environment and a thickness of the photoreceptor.

18. The xerographic marking engine control system of claim 11, wherein the offset value is selected to minimize photoreceptor wear based on the measured environment sensor data.

19. The xerographic marking engine control system of claim 11, wherein the offset value is selected to achieve a photoreceptor wear rate of at least 5 μm per one thousand cycles based on the measured environment sensor data.

20. A xerographic image forming device comprising the xerographic marking engine control system of claim 11.

* * * * *